US005458971A

United States Patent [19]

Hernandez et al.

[11] Patent Number: 5,458,971

[45] Date of Patent: Oct. 17, 1995

[54] PILLOWS AND OTHER FILLED ARTICLES AND IN THEIR FILLING MATERIALS

[75] Inventors: Ismael A. Hernandez, Winterville; William J. Jones, Jr., Greenville; Darren S. Quinn, LaGrange, all of N.C.

[73] Assignee: E. I. Du Pont de Nemours and Company, Wilmington, Del.

[21] Appl. No.: 315,748

[22] Filed: Sep. 30, 1994

[51] Int. Cl.[6] ..... D02G 3/00

[52] U.S. Cl. ..... 428/373; 428/374; 428/369; 428/362; 428/398; 428/397; 428/224; 428/221; 5/636; 5/448; 5/502; 5/482; 2/69.5; 19/296

[58] Field of Search ..... 428/373, 376, 428/397, 398, 362, 221, 369, 370, 371, 374, 288, 224; 5/636, 448, 502, 482; 2/69.5; 19/296

[56] References Cited

U.S. PATENT DOCUMENTS

| | | | |
|---|---|---|---|
| 3,520,770 | 6/1970 | Shima et al. | 428/373 |
| 4,818,599 | 4/1989 | Marcus | 428/224 |
| 5,141,805 | 8/1992 | Nohara et al. | 428/362 |

*Primary Examiner*—N. Edwards

[57] ABSTRACT

Pillows and other filled articles are filled with bicomponent polyester fibers that have "spiral crimp" on account of a difference in chain-branched content of the polyester polymers of the components. Such bicomponent fibers are preferably novel hollow "spiral crimp" bicomponent fibers.

13 Claims, 3 Drawing Sheets

PILLOWS AND OTHER FILLED ARTICLES AND IN THEIR FILLING MATERIALS

FIELD OF THE INVENTION

This invention concerns improvements in and relating to pillows and other filled articles, more generally, in and relating to their filling materials, and more particularly in and relating to polyester fiberfill filling material such as has "spiral crimp", including new such polyester fiberfill filling material, and new processes and new spinnerets for making them.

BACKGROUND ART

Polyester fiberfill filling material (sometimes referred to herein as polyester fiberfill) has become well accepted as a reasonably inexpensive filling and/or insulating material especially for pillows, and also for cushions and other furnishing materials, including other bedding materials, such as sleeping bags, mattress pads, quilts and comforters and including duvets, and in apparel, such as parkas and other insulated articles of apparel, because of its bulk filling power, aesthetic qualities and various advantages over other filling materials, so is now manufactured and used in large quantities commercially. "Crimp" is a very important characteristic. "Crimp" provides the bulk that is an essential requirement for fiberfill. Slickeners, referred to in the art and hereinafter, are preferably applied to improve aesthetics. As with any product, it is preferred that the desirable properties not deteriorate during prolonged use; this is referred to generally as durability. Hollow polyester fibers have generally been preferred over solid filaments, and improvements in our ability to make hollow polyester fiberfill with a round periphery has been an important reason for the commercial acceptance of polyester fiberfill as a preferred filling material. Examples of hollow cross-sections are those with a single void, such as disclosed by Tolliver, U.S. Pat. No. 3,772,137, and by Glanzstaff, GB 1,168,759, 4-hole, such as disclosed in EPA 2 67,684 (Jones and Kohli), and 7-hole, disclosed by Broaddus, U.S. Pat. No. 5,104,725, all of which have been used commercially as hollow polyester fiberfill filling material. Most commercial filling material has been used in the form of cut fibers (often referred to as staple) but some filling material, including polyester fiberfill filling material, has been used in the form of deregistered tows of continuous filaments, as disclosed, for example by Watson, U.S. Pat. Nos. 3,952,134, and 3,328,850.

Generally, for economic reasons, polyester fiberfilling material, especially in the form of staple, has been made bulky by mechanical crimping, usually in a stuffer box crimper, which provides primarily a zigzag 2-dimensional type of crimp, as discussed, for example, by Halm et al in U.S. Pat. No. 5,112,684. A different and 3-dimensional type of crimp, however, can be provided in synthetic filaments by various means, such as appropriate asymmetric quenching or using bicomponent filaments, as reported, for example, by Marcus in U.S. Pat. No. 4,618,531, which was directed to providing refluffable fiberballs (sometimes referred to in the trade as "clusters") of randomly-arranged, entangled, spirally-crimped polyester fiberfill, and in U.S. Pat. No. 4,794,038, which was directed to providing fiberballs containing binder fiber (in addition to the polyester fiberfill) so the fiberballs containing binder fiber could be molded, for example, into useful bonded articles by activating the binder fibers. Such fiberballs of both types have been of great commercial interest, as has been the problem of providing improved polyester fiberfill having "spiral crimp". The term spiral crimp is frequently used in the art, but the processes used to provide synthetic filaments with a helical configuration (perhaps a more accurate term than spiral crimp) does not involve a "crimping" process, in a mechanical sense, but the synthetic filaments take up their helical configuration spontaneously during their formation and/or processing, as a result of differences between portions of the cross-sections of the filaments. For instance, asymmetric quenching can provide "spiral crimp" in monocomponent filaments, and bicomponent filaments of eccentric cross-section, preferably side-by-side but also with one component off-centered, can take up a helical configuration spontaneously.

Polyester fibers having spiral crimp are sold commercially. For instance H18Y polyester fibers are available commercially from Unitika Ltd. of Japan, and 7-HCS polyester fibers are available commercially from Sam Yang of the Republic of Korea. Both of these commercially-available bicomponent polyester fibers are believed to derive their spiral crimp because of a difference in the viscosities (measured as intrinsic viscosity, IV, or as relative viscosity RV), i.e., a difference in molecular weight of the poly(ethylene terephthalate), used as the polymer for both components to make the bicomponent fiber. Use of differential viscosity (delta viscosity) to differentiate the 2 components presents problems and limitations, as will be discussed. This is primarily because spinning bicomponent polyester filaments of delta viscosity is difficult, i.e., it is easier to spin bicomponent filaments of the same the viscosity, and there is a limit to the difference in viscosity that can be tolerated in practice. Since it is the delta viscosity that provides the desirable spiral crimp, this limit on the difference that can be tolerated correspondingly limits the amount of spiral crimp that can be obtained in a delta viscosity type of bicomponent. Accordingly it has been desirable to overcome these problems and limitations.

Crimpable composite filaments have been disclosed by Shima et at, U.S. Pat. No. 3,520,770, by arranging two different components of polymeric ethylene glycol terephthalate polyesters eccentrically and in intimate adherence to each other along the whole length of the filaments, at least one of the said components being a branched polymeric ethylene glycol terephthalate polyester chemically modified with at least one branching agent having 3 to 6 ester-forming functional groups and at least one of said components being an unbranched polymefic ethylene glycol terephthalate polyester. Shima taught use of such filaments in woven fabrics made of such cut staple filaments. Shima did not teach use of his bicomponent filaments as filling material. Shima did not provide any teaching regarding pillows, nor about filled articles, nor about filling materials.

SUMMARY OF THE INVENTION

We have found, according to the present invention, that a difference between the chain-branched contents of polyester components can provide advantages in polyester bicomponent fibers for use as polyester fiberfill filling materials in filled articles, especially in pillows, and in new hollow polyester bicomponent fibers for such use. We use herein both terms "fiber" and "filament" inclusively without intending use of one term to exclude the other.

According to one aspect of the invention, therefore, we provide a pillow filled with polyester fiberfill filling material, said polyester fiberfill filling material comprising at least 50% by weight of bicomponent polyester fiberfill fibers of helical configuration that has resulted from a difference between chain-branched contents of polyester components of said bicomponent polyester fiberfill fibers. Preferably 100% of the filling material is such bicomponent fibers but, as will be understood, blends of filling materials may be used in practice by some operators, e.g., 10/90, 25/75 or whatever may be considered desirable for any reason.

As indicated, pillows are a very significant part of the market for filled articles, but this invention is not restricted only to pillows, and, accordingly, we provide, more generally, filled articles filled with filling material, said filling material comprising at least 50% by weight of bicomponent polyester fiberfill fibers of helical configuration that has resulted from a difference between chain-branched contents of polyester components of said bicomponent polyester fiberfill fibers. In particular, preferred such filled articles, according to the invention, include articles of apparel, such as parkas and other insulated or insulating articles of apparel, bedding materials (sometimes referred to as sleep products) other than pillows, including mattress pads, comforters and quilts including duvets, and sleeping bags and other filled articles suitable for camping purposes, for example, furnishing articles, such as cushions, "throw pillows" (which are not necessarily intended for use as bedding materials, and filled furniture itself, toys and, indeed, any articles that can be filled with polyester fiberfill. The remainder may be other polyester filling material, which has an advantage of being washable, and is preferred, but other filling material may be used if desired.

Such articles may be filled (at least in part) with fiberballs (clusters), in which the bicomponent polyester fiberfill fibers of helical configuration are randomly entangled into such fiberballs. Such may be moldable, on account of the presence of binder fiber, as disclosed by Marcus in U.S. Pat. No. 4,794,038, for example, and Halm et al in U.S. Pat. No. 5,112,684, or refluffable, as disclosed, for example by Marcus in U.S. Pat. No. 4,618,531 and also by Halm et at.

Also provided, according to the invention, are such fiberballs themselves, wherein the bicomponent polyester fiberfill fibers of helical configuration are randomly entangled to form such fiberballs.

Filled articles according to the invention also include articles wherein (at least some of) the filling material is in the form of batting, which may be bonded, if desired, or left unbonded.

Preferably, (some at least of) such bicomponent polyester fiberfill fibers are hollow in filled articles, according to the invention, especially with multiple voids, i.e., contain more than one continuous voids along the fibers, as has been disclosed in the art. Particularly preferred are such fibers having three continuous voids, e.g., as disclosed hereinafter, with a round peripheral cross-section. We believe no one has disclosed how to spin round filaments with 3 holes.

Also provided, according to other aspects of the invention, are such new hollow bicomponent polyester fiberfill fibers themselves, and new processes and new spinnerets for making them.

Preferably, at least some such bicomponent polyester fiberfill fibers are slickened in the filled articles, according to the invention, i.e., are coated with a durable slickener, as disclosed in the art. As disclosed hereinafter, a blend (mixture) of slickened and unslickened bicomponent polyester fiberfill fibers according to the invention may have processing advantages.

Also provided, according to another aspect of the invention are such new slickened bicomponent polyester fiberfill fibers themselves.

DETAILED DESCRIPTION OF THE INVENTION

Figure 1:
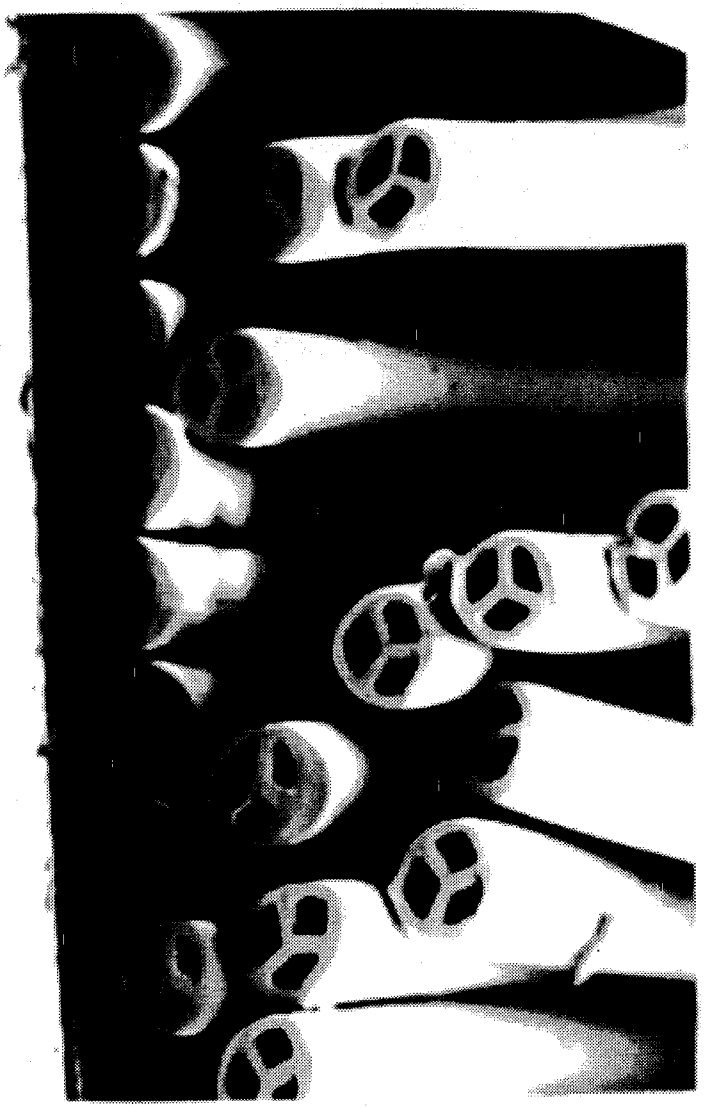
FIG. 1 is an enlarged photograph of several cross-sections of preferred bicomponent 3-hole filament embodiments of the invention.

As indicated, an important aspect of the invention is a novel use for bicomponent polyester fibers of helical configuration that has resulted from a difference between chain-branched contents of polyester components of said bicomponent polyester fibers. The idea of using a difference (between one component being unbranched polymeric ethylene glycol terephthalate polyester and another component being branched with at least one branching agent having 3 to 6 ester-forming functional groups) in a bicomponent polyester filament for use in woven fabrics has already been disclosed by Shima (et al, U.S. Pat. No. 3,520,770) more than 20 years earlier. Chain-branching for polyester fiberfill purposes has also been disclosed in EP published application 0,294,912 (DP-4210) in a different context entirely. The technology of making such chain-branched polyester polymer has accordingly already been disclosed in this art (the disclosure of which is hereby incorporated herein by reference), and it would be redundant to repeat such technology herein. In practice, it will generally be preferred to use unbranched polyester polymer as one component, and a chain-branched polymer as the other component, as did Shima, and it will generally be preferred to use the unbranched polyester polymer as the major component, since unbranched polymer is cheaper. Neither of these is, however, necessary, and it may sometimes, for instance, be desirable for both components to be chain-branched, with differences between the chain-branching in order to provide the desired helical configuration. Similarly, it may be desirable to make the bicomponent filament from more than two components, but, in practice, only two components are likely to be preferred. Shima was not concerned with the field of the present invention, namely filled articles, such as and especially pillows, and their filling materials, and did not disclose how to make such articles.

Reverting to the field of the invention, namely filled articles and their filling with polyester fiberfill, the bicomponent polyester fiberfill fibers of the present invention have important advantages over bicomponents available commercially hitherto as follows:

1- Our polymer selection allows us to spin solid, 1-hole, or multi hole cross sections as self-crimping fibers. We can thus tailor the cross-section to several different particular end use needs. We have demonstrated solid, 1-hole, 3-hole and 7-hole fibers of round cross-section peripherally. In effect, we believe that, if a capillary can be used to spin a conventional fiber we can spin a self-crimping bicomponent with that capillary.

2- We can vary and have varied the polymer ratio to obtain levels of crimp from no crimp to microcrimp. With other technologies such as delta RV, there is not enough differential between the polymers to allow straying too far from 50/50 (equal amounts of each component of different RV).

3- We can use and have used a single spinneret to spin a variety of crimp levels by changing the polymer ratio. Other technologies would require changing the capillary geometry if the polymer ratio were changed significantly. We have demonstrated polymer ratios varying from 10/90 to 50/50.

4- We believe the use of these two higher viscosity polymers (both components being of higher viscosity) vs. delta RV results in a more durable crimp.

5- We can make void contents up to 40% in a "spiral crimp" fiber, whereas fibers of such high void content would collapse at the nodes if mechanically-crimped.

6- We were surprised to find that the crimp development did not depend on the draw ratio selected, but on the polymer ratio selected. Thus, we were surprised to find we got the same crimp level even when a draw ratio was varied from 2.5X to 5X. This is an important and surprising advantage in processing, since it enables a manufacturer to maintain a constant level of crimp despite fluctuations in drawing conditions.

Suitable filament deniers will generally range from 1.5 to 20 dtex for the final drawn fiberfill, 2–16 dtex being preferred in most cases, and 4–10 dtex being generally most preferred, it being understood that blends of different deniers may often be desirable, especially with the current interest in low deniers (era microdeniers), especially for insulating and/or aesthetic purposes.

As indicated, we believe that the bicomponent "spiral crimp" polyester fibers that are commercially available (H18Y and 7-HCS) use both components of ethylene terephthalate homopolymer (2G-T), but with differing viscosities (RV for relative viscosity). We have found that a delta (difference) of about 6RV units is the only delta that is easily spinnable and that gives good bicomponent spiral crimp, that a delta less than about 6RV units can be spun but gives low "spiral crimp", whereas it is difficult to spin filaments with a delta higher than about 6RV units. WE believe H-18Y has an average RV of 17.9 LRV (LRV is measured as disclosed in Example 1 of Broaddus U.S. Pat. No. 5,104,725) which means that we believe H-18Y is probably a 50/50 side-by-side bicomponent of 2G-T polymers of 15 LRV and of 21 LRV. We believe 7-HCS has an average LRV of 15, which means that we believe 7-HCS is probably a 50/50 side-by-side bicomponent of 2G-T polymers of 12 LRV and of 18 LRV. In contrast, with a combination of chain-branched and unbranched 2G-T polymers we an spin filaments according to the invention of equivalent LRVs, and indeed the LRV of the blend of polymers that we used in our Examples was measured at 22.7.

Of particular interest, as indicated, are round multivoid bicomponent filaments according to the invention and slickened bicomponent filaments according to the invention, both of which are believed to be new. A preferred round multivoid filament is now described and illustrated in the accompanying Drawings.

Figure 2:
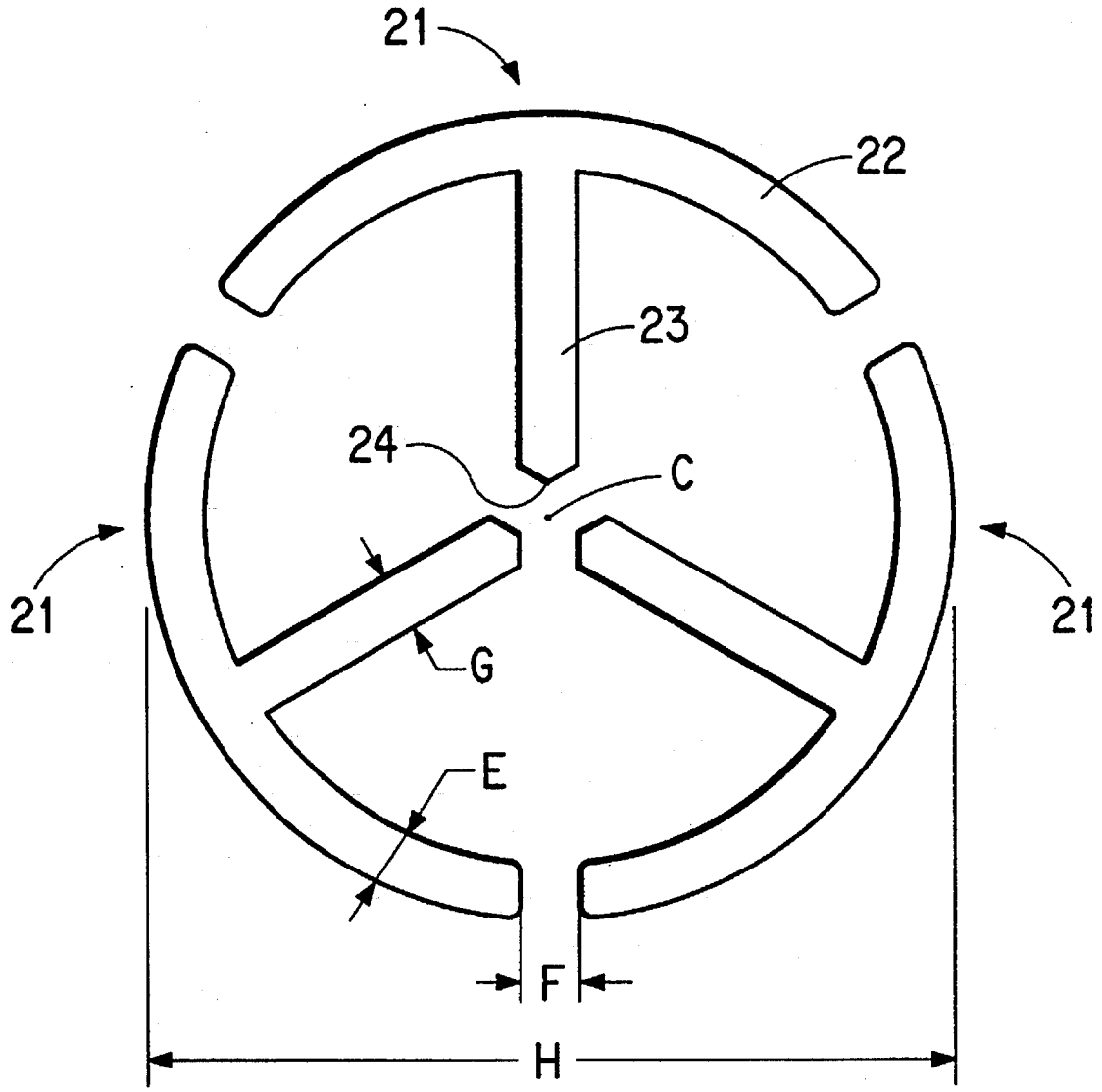
FIG. 2 is an enlarged view of a spinneret capillary according to the invention viewed from the lower surface of the spinneret, for spinning a 3-hole filament.
Figure 3:
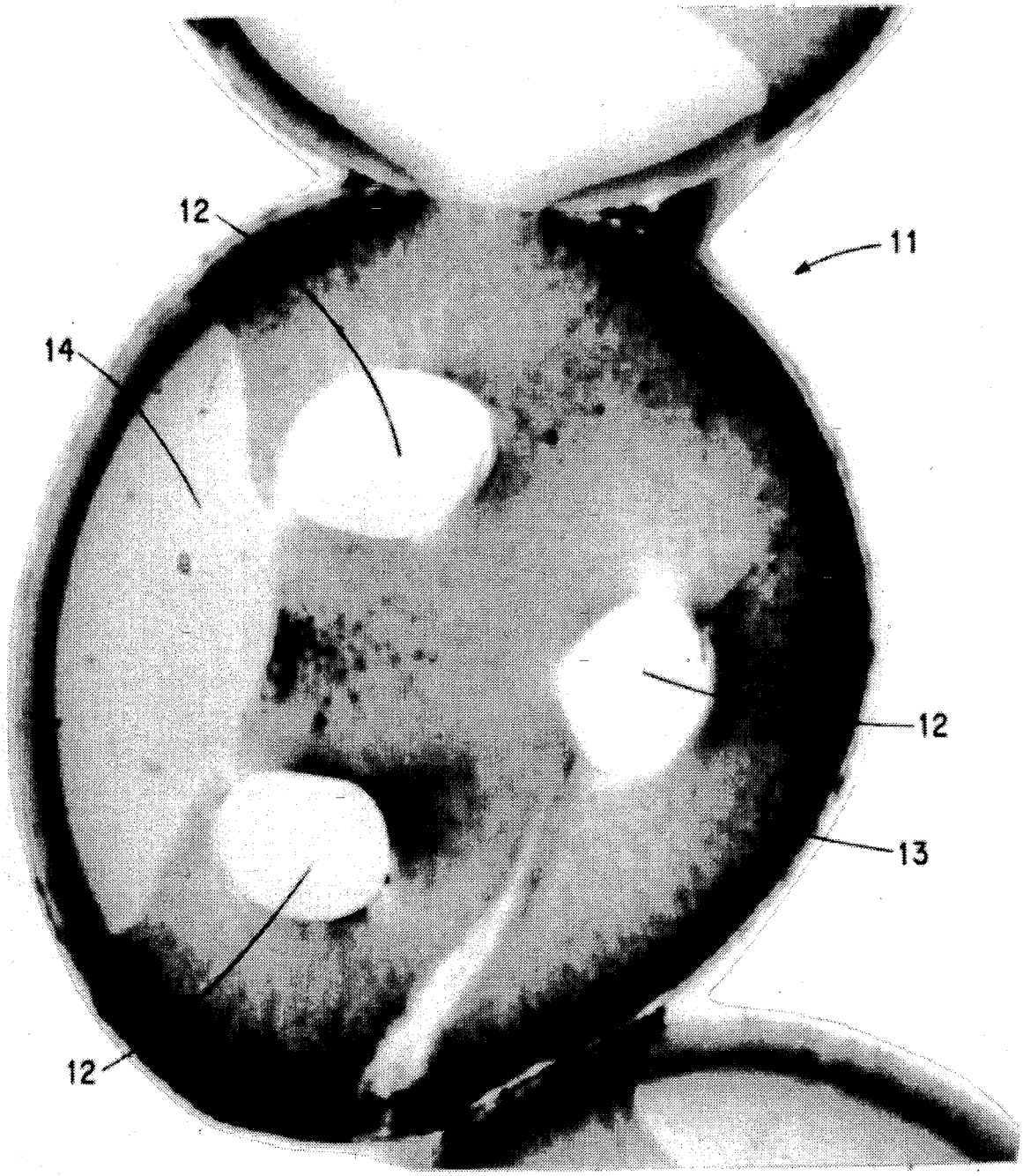
FIG. 3 is an enlarged photograph of another 3-hole bicomponent filament cross-section that has been stained to show a borderline between the two components.

Referring to the accompanying Drawings, FIG. 1 is a photograph to show several cross-sections of 3-hole bicomponent filaments spun from a spinneret capillary as shown in FIG. 2. Three voids (holes) can clearly be seen in each of the filaments shown in FIG. 1, but the borderline between the two components is not so visible, so an enlarged photograph of another 3-hole filament cross-section (82/18 proportions of the two components) is provided stained for this purpose in FIG. 3. Referring to FIG. 3, the filament generally is indicated by reference numeral H, and contains three voids 12. Two polymeric components 13 and 14 are shown in FIG. 3, with a clearly defined borderline between these different components. This boundary was visible after the filament cross-section had been stained with osmium tetroxide, which stained the components differently so the borderline shows up better in FIG. 3 than in FIG. 1. In this instance, all three voids 11 are shown located within the majority polymefic component 13. It will be understood that this will not necessarily happen, especially when more of a second component is present than shown in FIG. 3 for component 14, The filaments have round (circular) peripheral cross-section, which is important and preferred for fiberfill materials.

FIG. 2 shows a spinneret capillary for spinning filaments with three voids. It will be noted that the capillary is segmented, with three segments 21 disposed symmetrically around an axis or central point C. Each segment 21 consist of two slots, namely a peripheral arcuate slot 22 (width E) and a radial slot 23 (width G), the middle of the inside edge of peripheral arcuate slot 22 being joined to the outer end of radial slot 23, so each segment forms a kind of "T-shape" with the top of the T being curved convexly to form an are of a circle. Each peripheral arcuate slot 22 extends almost 120° around the circumference of the circle. Each radial slot 23 comes to a point 24 at its inner end. Points 24 are spaced from central point C. Outer diameter H of the capillary is defined by the distance between the outer edges of peripheral arcuate slots 22. Each peripheral arcuate slot 22 is separated from its neighbor by a distance F, which is referred to as a "tab" .

The short faces of neighboring peripheral arcuate slots 22 on either side of each tab are parallel to each other and parallel to the radius that bisects such tab. In many respects, the capillary design shown in FIG. 2 is typical of designs used in the art to provide hollow filaments by post-coalescence spinning through segmented orifices. A segmented design for post-coalescence spinning 4-hole filaments is shown, for example, by Champanefia et al in U.S. Pat. No. 3,745,061. Points 24 at the inner ends of radial slots 23 are provided in the spinneret capillary design shown in FIG. 2, however, to improve coalescence of the polymer at the center of the filament, i.e., to ensure that the three voids do not become connected.

TEST METHODS

The perameters mentioned herein are standard parameters and are mentioned in the art referenced herein, as are methods for measuring them. Since methods of measuring bulk of pillows can vary, the method we used to test the pillows in our Examples is summarized briefly:

Pillows fabricated from a filling material having the most effective bulk or filling power will have the greatest center height. The Initial Height of the center of a pillow under zero load is determined by mashing in the opposite comers of the pillow several times (refluffing) and placing the pillow on the load-sensitive table of an Instron tester and measuring and recording its (Initial) Height at zero load. The Instron tester is equipped with a metal disc presser foot that is 4 in. (10.2 cm.) in diameter. The presser foot is then caused to compress the pillow by continuously increasing the load until 20 lbs. (9.08 kg) is applied. The load required to compress the center section of the pillow to 50% of the Initial Height under zero load is measured and this load-to-half-height is recorded as the "Firmness" of the pillow.

Before the actual compression cycle in which the Initial Height and Firmness are measured and recorded, the pillow is subjected to one complete cycle of 20 lbs (9.08 kg) compression and load release for conditioning. Pillows having higher load-to-half-height values are more resistant to deformation and thus provide greater support bulk.

Bulk and Firmness durability are determined by submitting the filling material in the pillow to repeated cycles of compression and load release, followed by a washing and drying cycle. Such repeated cycles, or workings, of the pillows are carried out by placing a pillow on a turntable associated with 2 pairs of 4×12 inch (10.2×30.5 cm) air-powered worker feet which are mounted above the turntable in such a fashion that, during one revolution, essentially the entire contents are subjected to compression and release. Compression is accomplished by powering the worker feet with 80 lbs. per square inch (5.62 kg/square era) gauge air pressure such that they expert a static load of approximately 125 lbs (56.6 kg) when in contact with the turntable. The turntable rotates at a speed of one revolution per 110 seconds and each of the worker feet compresses and releases the filling material 17 times per minute. After being repeatedly compressed and released for a specified period of time, the pillow is refluffed by mashing in the opposite corners several times. As before, the pillow is subjected to a conditioning cycle and the Initial Height and Firmness (load-to-half-height) are determined. The pillow is then subjected to a normal home laundry washing and drying cycle. After drying it is again refluffed by mashing in the opposite corners several time and allowed to stand overnight. After this conditioning period, the pillow is again measured for Initial Height and Firmness (load-to-half-height) using the Instron technique above, and recording measurements after one complete cycle.

The invention is further illustrated in the following Examples; all parts and percentages are by weight, unless otherwise indicated. The spinneret capillary used for spinning 3-hole polyester fiber in the Examples was as illustrated in FIG. 2, with the following dimensions in inches: H(outer diameter) 0.060 inches; E(width of slot 22), F (tab) and G(width of slot 23) all 0.004 inches; points 24 were defined by the faces at the inner end of each radial slot 23 on either side of point 24, each such face being aligned with a short face at the extremity of the corresponding peripheral arcuate slot 22, i.e., on one side of a tab of width F, so as to provide corresponding distances also of width F (0.004 inches) between each pair of parallel faces at the inner ends of each pair of radial slots 23. The capillary slots were of depth 0.010 inches, and were fed from a reservoir as shown in FIG. 6A of U.S. Pat. No. 5,356,582 (Aneja et at) and with a meter plate registered for spinning side-by-side bicomponent filaments, as disclosed in the art.

EXAMPLE 1

Bicomponent fibers according to the invention were produced from two different component polymers, both of 0.66 IV. One component polymer (A) was homopoly(ethylene terephthalate), while the other component polymer (B) contained 3500 ppm of tri mellitate chain-brancher (analyzed as trimethyl trimellitate, but added as trihydroxyethyl trimellitate). Each was processed simultaneously through a separate screw melter at a combined polymer throughput of 190 lbs/hr. (86 kg/hr). Use of a meter plate with orifices just above each of 1176 spinneret capillaries allowed these molten polymers to be combined in a side-by-side manner in a ratio of 80% (A) and 20% (B) and spun into filaments at 0.162 lbs/hr/capillary (0.074 kg/hr/capillary) and 500 ypm (457 m/min). The post-coalescent capillaries (FIG. 2) were designed to give fibers with three equi-spaced and equi-sized voids parallel to the fiber axis. The resulting hollow fibers (of spun denier=25 and void content 12.5%) were quenched in a cross-flow manner with air at 55° F. (18° C). The spun fibers were grouped together to form a rope (relaxed tow denier of 360,000). This rope was drawn in a hot wet spray draw zone maintained at 95° C. using a draw ratio of 3.5X. The drawn filaments were coated with a slickening agent containing a polyaminosiloxane and laid down with an air jet on a conveyor. The filaments in the rope on the conveyor were now observed to have helical crimp. The (crimped) rope was relaxed in an oven at 175° C., after which it was cooled, and an antistatic finish was applied at about 0.5% by weight, after which the rope was cut in a conventional manner to 3 in. (76 mm). The finished product had a denier per filament of 8.9. The fibers had a cross section similar to that shown in FIG. 3 (which fiber actually contained slightly different (82/18) proportions of polymer A/B), containing three continuous voids which were parallel and substantially equal in size and substantially equi-spaced from each other. The periphery of the fiber was round and smooth. Various properties of the fibers were measured and are compared in Table 1A, with commercial bicomponent fibers of the delta-RV type marketed by Unitika (Japan) and Sam Yang (South Korea).

Pillows were prepared from cut bicomponent staples of the Example above and also from the commercially available 6-H18Y (Llnitika) and 7-HCS (Sam Yang) by being were opened by passing though a picker and then processing on a garnett (such as a single cylinder double doffer model manufactured by James Hunter Machine Co. of North Adams, Mass.). Two webs of opened fibers were combined and rolled up to form pillow batting. The weight of each pillow was adjusted to 18 oz. (509) gm) and each was then conveyed into 20 in. (51 cm)×26 in. (66 cm) tickings of 200 count 100% cotton fabric using a Bemiss pillow stuffer. The pillows (after a refluffing) were measured for Initial Height and Firmness, which are shown in Table 1B.

The 18 oz (509 gm) pillows of the invention made by this Example have very good filling power, much more so than typical mechanically-crimped slickened fibers, to the extent that we believe that such a pillow filled with as little as 18 oz of our novel hollow bicomponent spiral crimp fiber can provide as much as filling power in a pillow as a prior art pillow filled with 20 oz of commercial mechanically crimped fiber, which is a significant saving; there is also an economic advantage in avoiding the need to use a stuffer box (for mechanical crimping) which can also risk damaging the fibers. These pillows had Initial Height superior to 7-HCS and about equivalent to H-18Y. In contrast to 18 oz (509 gm) pillows with good filling power of the art, these pillows of Example 1 were firm. Their Firmness was greater than for either competitive fiber.

An important advantage of pillows of the invention (and of our novel filling fiber therein) over pillows filled with prior commercially-available spiral crimp fiber is also the versatility and flexibility that use of our technology provides, as will be shown in Example 2.

TABLE 1A

| Physical Properties of Bicomponent Fibers | | | |
|---|---|---|---|
| Item | Example 1 | H18Y | 7-HCS |
| DPF | 8.9 | 6.0 | 7.0 |
| Crimp/inch (cm) | 6.1 (15.5) | 5.0 (12.7) | 5.4 (11.9) |
| % void | 11.4 | 25.1 | 3.8 |
| TBRM | | | |
| in. (cm @ 0.001 PSI | 5.56 (14.1) | 5.81 (14.8) | 5.76 (14.6) |
| in. (cm @ 0.2 PSI | 0.66 (1.68) | 0.56 (1.42) | 0.36 (0.91) |
| Staple Pad Friction | 0.353 | 0.262 | 0.246 |
| % silicon | 0.324 | 0.210 | 0.215 |

TABLE 1B

| Properties of 18 oz. rolled batting pillows | | | |
|---|---|---|---|
| Item<br>Initial Pillow | Example 1 | H18Y | 7-HCS |
| Height in (cm) | 8.98 (19.8) | 9.18 (23.3) | 7.69 (19.5) |
| Firmness lbs (kg) | 7.97 (3.62) | 7.04 (3.20) | 3.29 (1.50) |

EXAMPLE 2

A series of bicomponent fibers according to the invention with differing crimp frequencies were prepared by varying the ratio of the two polymer components, A and B, of Example 1. The proportion of polymer A was varied from 70% up to 84% as the proportion of polymer B was varied from 30% down to 16% as shown in Table 3. Using the same spinning process as in Example 1, the differing polymer combinations were spun into a series of bicomponent fibers having visually different crimp frequencies. Their physical properties are given in Table 2. Each of these fibers was converted into standard roll batting pillows as in Example 1. The properties of the pillows are given in Table 2. In general, an increase in pillow Firmness was noted as the content of polymer B in the fiber was increased from 16% to 22%, corresponding to the increase in crimp frequency obtained for the bicomponent fibers, a B polymer content of 22% giving a crimp frequency of about 7 cpi and a pillow Firmness of about 10 lbs, both of which are even better than those of the pillow of Example 1 which, in turn, had values better than those of the commercially available products (as shown in Table 1), while a B polymer content of 30% gave an even higher void content and good values of crimp frequency and Firmness.

TABLE 2

| PROPERTIES OF FIBERS AND PILLOWS IN CRIMP SERIES | | | | |
|---|---|---|---|---|
| Item | A | B | C | D |
| % polymer A | 70 | 78 | 80 | 84 |
| % polymer B | 30 | 22 | 20 | 16 |
| DPF | 8.7 | 8.8 | 8.9 | 9.6 |
| Crimp/in (cm) | 6.8 (17.3) | 7.1(18.0) | 5.7 (14.5) | 3.9 (9.90) |
| % void | 14.6 | 11.4 | 11.5 | 9.4 |
| TBRM Height | | | | |
| In (cm) @ .001 PSI | 4.52 (11.5) | 5.24 (13.3) | 5.54 (14.1) | 5.64 (14.3) |
| In (cm) @ .2 PSI | 0.95 (2.4) | 0.82 (2.1) | 0.65 (1.7) | 0.50 (1.3 |

TABLE 2-continued

| PROPERTIES OF FIBERS AND PILLOWS IN CRIMP SERIES | | | | |
|---|---|---|---|---|
| Item | A | B | C | D |
| SPF | 0.558 | 0.405 | 0.355 | 0.294 |
| % silicon | 0.313 | 0.317 | 0.324 | 0.303 |
| Initial pillow: | | | | |
| Height, in (cm) | 9.40 (23.9) | 9.14 (23.2) | 8.98 (22.8) | 9.16 (23.3) |
| Firmness, lbs (kg) | 9.20 (4.18) | 10.02 (4.55) | 7.97 (3.62) | 6.33 (2.87) |

Preferred proportions of the different polymers in bicomponent fibers according to our invention range from about 10/90 to 30/70. In Example 2, one component was branched with 3500 ppm (measured as disclosed above) of a chain-brancher which is preferred for reasons discussed in EPA published application 0,294,912, but other chain-branchers as disclosed therein and by Shima may, if desired be used, and, with this preferred chain-brancher, such proportions correspond to crimp frequencies of about 2–8 CPI, respectively. Even 50/50 bicomponent proportions would be expected to be useful if modifications were made to various features, such as the amount of chain-brancher, for instance using about 700 ppm, whereas proportions of 10/90 might give useful results with as much as 17,500 ppm (the chain-brancher being measured as disclosed above)

Preferred void contents in bicomponent hollow fibers according to our invention range from 5 % up to 40%, especially 10–30%.

EXAMPLE 3

Because opened slickened bicomponent fibers give such weak web cohesion that some find it difficult to combine the webs into batting and to handle the batting in a pillow ticking stuffing operation, we combined a minor proportion of unslickened fibers with a majority of slickened fibers in the cutting operation. A 75%/25% slickened/unslickened blend was prepared by cutting three 390,000 denier ropes of the slickened fiber from item B in Example 2 combined with one equivalent rope of the same bicomponent fiber to which no silicone slickener had been applied.. The resulting staple blend (cut length 3 inches, 7.6 cm) had a noted increase in fiber-fiber friction as measured by an SPF increase from 0.391 to 0.412. This blend was processed easily on a garnett with much improved operability vs. the all-slickened product of item B of Example 2 into 18 oz with the pillow of the all-slick product in Example 2, item B. A comparison of pillow properties in Table 3 before and after A stomp/wash/dry cycle shows that the addition of unslickened fiber did not adversely affect the advantageous properties of the pillow.

TABLE 3

| Properties of Blended Bicomponent Pillows | | | | |
|---|---|---|---|---|
| | 75/25 slickened/ non-slick blend | | all-slick | |
| | height in (cm) | firmness lbs (kg) | height in (cm) | firmness (kg) |
| Initial Pillow | 9.16 (23.3) | 9.68 (4.40) | 9.14 (23.2) | 10.02 (4.55) |
| After 1 stomp/ | 9.06 (23.0) | 6.70 (3.05) | 9.01 (22.9) | 7.00 (3.18) |

TABLE 3-continued

| Properties of Blended Bicomponent Pillows | | | | |
|---|---|---|---|---|
| | 75/25 slickened/ non-slick blend | | all-slick | |
| | height in (cm) | firmness lbs (kg) | height in (cm) | firmness (kg) |
| wash cycle | | | | |

The proportions of slickened to unslickened bicomponent polyester fiberfill fibers may be varied as desired for aesthetic purposes and/or as needed or desirable for processing, e.g. as little as 5 or 10% of one type of fiber, or more, and the 25/75 mixture used in Example 3 is not intended to be limiting and may not even be optimum for some purposes.

We claim:

1. A pillow filled with polyester fiberfill filling material, said polyester fiberfill filling material comprising at least 50% by weight of bicomponent polyester fiberfill fibers of helical configuration that has resulted from a difference between a first component of said bicomponent polyester fiberfill fibers being unbranched polymeric ethylene glycol terephthalate polyester and a second component being polymeric ethylene glycol terephthalate polyester branches with at least one branching agent having 3 to 6 ester-forming functional group.

2. Filled articles filled with filling material, said filling material comprising at least 50% by weight of bicomponent polyester fiberfill fibers of helical configuration that has resulted from a difference between a first component of said bicomponent polyester fiberfill fibers being unbranched polymeric ethylene glycol terephthalate polyester and a second component being polymeric ethylene glycol terephthalate polyester branched with at least one branching agent having 3 to 6 ester-forming functional groups.

3. An article according to claim 2 that is an article of apparel.

4. An article according to claim 2 that is a bedding material.

5. An article according to claim 4 that is a sleeping bag.

6. An article according to claim 4 that is a comforter.

7. An article according to claim 4 that is a quilt.

8. An article according to claim 2 that is a furnishing article.

9. An article according to claim 8 that is a cushion.

10. An article according to claim 2 that is a toy.

11. An article according to any one of claims 1 to 10, wherein said bicomponent polyester fiberfill fibers of helical configuration are randomly entangled into fiberballs.

12. An article according to any one of claims 1 to 10, wherein said filling material is in the form of batting.

13. An article according to claim 12, wherein said batting is bonded.

* * * * *